United States Patent [19]

Fujiwara et al.

[11] 4,295,015

[45] Oct. 13, 1981

[54] REPEAT TYPE TIME SWITCH

[75] Inventors: Ichiroh Fujiwara; Yoshiaki Motoki; Toshinori Inoue; Kazuma Fukuoka, all of Fukuyama, Japan

[73] Assignee: Mitsubishi Denki Kabushiki Kaisha, Tokyo, Japan

[21] Appl. No.: 73,133

[22] Filed: Sep. 6, 1979

[30] Foreign Application Priority Data

Sep. 14, 1978 [JP] Japan ..... 53-112930

[51] Int. Cl.[3] ..... H01H 7/00

[52] U.S. Cl. ..... 200/38 R; 74/568 FS; 74/568 T

[58] Field of Search ..... 200/38 R, 38 A, 38 F, 200/38 FA, 38 FB, 38 B, 38 BA, 38 C, 38 CA, 38 D, 38 DA, 38 DB, 38 DC, 38 E; 307/141; 74/568 R, 568 FS, 568 M, 568 T

[56] References Cited

U.S. PATENT DOCUMENTS 3,267,767 8/1966 Neal ..... 74/568 R

OTHER PUBLICATIONS

Japanese Patent Publication No. 9556/1967.

Japanese Unexamined Utility Model Publication No. 13871/1974.

*Primary Examiner*—J. V. Truhe

*Assistant Examiner*—Morris Ginsburg

*Attorney, Agent, or Firm*—Oblon, Fisher, Spivak, McClelland & Maier

[57] ABSTRACT

A time switch comprises a scale plate which is rotated at a constant velocity and change-over pawls and a cradle. In the time switch the change-over pawls respectively have each flexible thin body part and are projected outwardly from an annular part and the switch is controlled by deformation of the change-over pawls which can be shifted to two positions for interlocking to or detaching from a lever.

3 Claims, 7 Drawing Figures

REPEAT TYPE TIME SWITCH

BACKGROUND OF THE INVENTION

1. Field of the Invention

The present invention relates to a repeat type time switch. More particularly, it relates to an improvement of change-over pawls.

2. Description of the Prior Arts

A typical repeat type time switch is shown in FIG. 1 wherein a scale plate (1) is rotated at a constant velocity and a plurality of change-over pawls (2) are independently fitted to the peripheral part of the scale plate and a lever (3) is moved to the arrow line direction by the rising pawl whereby a switch is turned on or off at the raised position of the lever (3) shown by the dashed line.

The change-over pawl (2) can be selectively positioned at two positions. That is, when the pawl (2) is raised as shown in FIG. 3, the tooth (2*a*) is fitted to the lever (3) whereas when the pawl (2) is fallen as shown FIG. 4, the tooth (2*a*) is detached from the lever (3).

The positioning of the pawl at the two positions is attained by the resilience of the pawl and the friction resulted between the pawl and the contact part such as the scale plate (5), a guide (6) and a tension plate (7).

Rectangular holes (5*a*) in which each pawl is inserted are formed on the scale plate (5) for the number of the pawls each with an equal gap. The guide (6) can be a groove (6*a*) for preventing the movement of the pawl (2) to the tangential direction with the regulation of the rectangular holes (5*a*) on the scale plate. The grooves (6*a*) are formed for the number of the pawls each with an equal gap. The tension plate (7) is to prevent the falling of the pawl (2) and a rivet (8) is to fix the contacted parts into one piece.

In said structure, when the change-over pawl (2) corresponding to a desired time is raised at the upper position, the switch (4) can be turned on and off for the time proportional to the number of the raised pawls (2) from such time.

However, the conventional time switch having said structure, has been prepared as follows. As shown in FIG. 4, the independent change-over pawls (2) are respectively inserted into the rectangular holes (5*a*) on the scale plate and the groove (6*a*) of the guide and the pawls are pressed by the tension plate (7) and are fixed by caulking the tension plate by the rivet (8).

Therefore, the following disadvantages are found.

(1) Each pawl is prepared by press-stamping whereby a long operation time is required for the preparation of the parts and a uniformity of the quality of the parts are not easily attained and a large loss of the substance is found (loss of the substance in the preparation of the parts).

(2) Each small pawl is fitted to the scale plate whereby a long time for assembling is needed and an automatic operation for the assembling is not easy.

(3) Tack assembled change-over pawls are easily detached before caulking for fixing. Accordingly, special care is needed in the assembling.

(4) A fault of the assembling in failure or error is easily caused.

(5) The parts are relatively small and a large number of the parts is assembled whereby the control for the parts are not easy (in the conventional one 96 parts are assembled).

SUMMARY OF THE INVENTION

It is an object of the present invention to provide a time switch which is economical and has high quality and overcome the disadvantages of the conventional time switch.

BRIEF DESCRIPTION OF THE DRAWINGS

FIG. 5 is a disassembled schematic view of the change-over pawls while FIGS. 6 and 7 are respectively views for showing relative relations of the change-over pawl and the lever.

DETAILED DESCRIPTION OF THE PREFERRED EMBODIMENTS

Figure 1A:
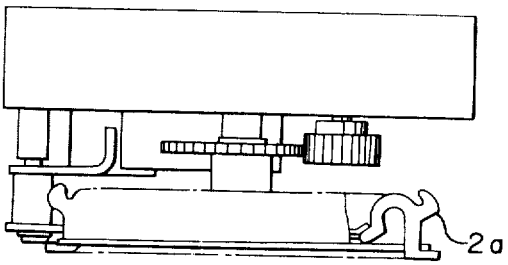
PRIOR ART FIG. 1a
FIGS. 1(*a*), (*b*) are schematic views of a structure of a typical repeat type time switch.
Figure 1B:
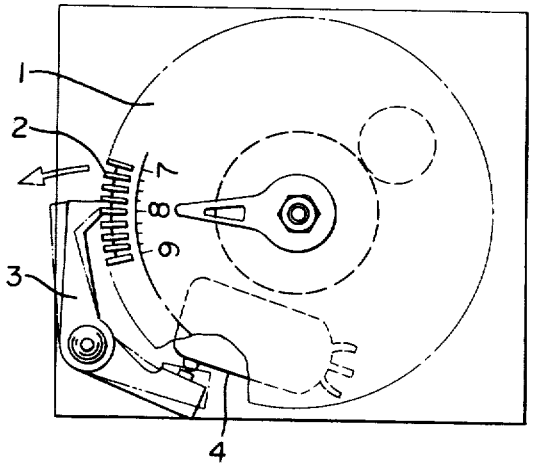
PRIOR ART FIG. 1b
Figure 2:
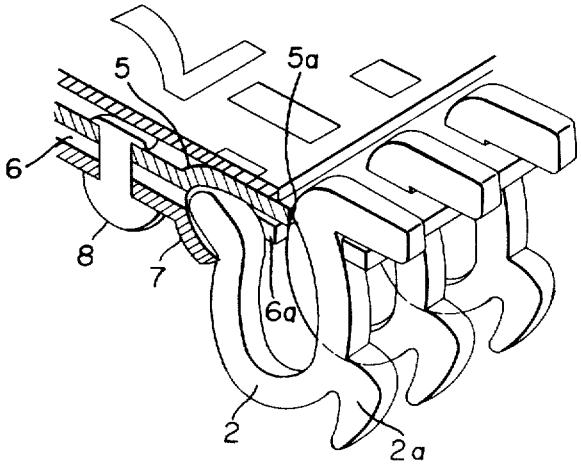
PRIOR ART FIG. 2
FIG. 2 is a schematic view of change-over pawls in the conventional time switch.
Figure 3:
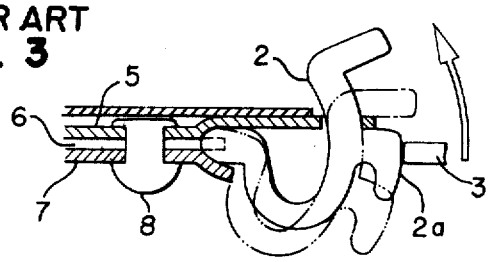
PRIOR ART FIG. 3
FIGS. 3 and 4 are respectively views for showing relative relations of the change-over pawl and a lever shown in FIG. 2.
Figure 4:
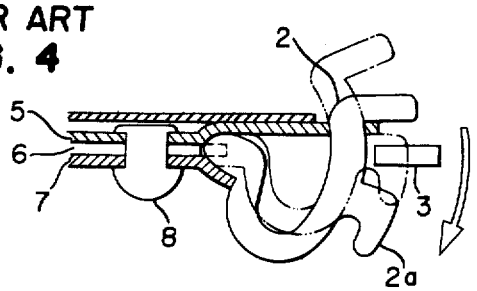
PRIOR ART FIG. 4

Referring to the drawings, one embodiment of the present invention will be illustrated.

In the embodiment of the present invention, the time switch is turned on or off at a predetermined time for a predetermined period by raising the change-over pawls manually as the same with that of the conventional time switch. Thus, the change-over pawls are formed in one piece by a resin molding or casting in the present invention.

Figure 5:
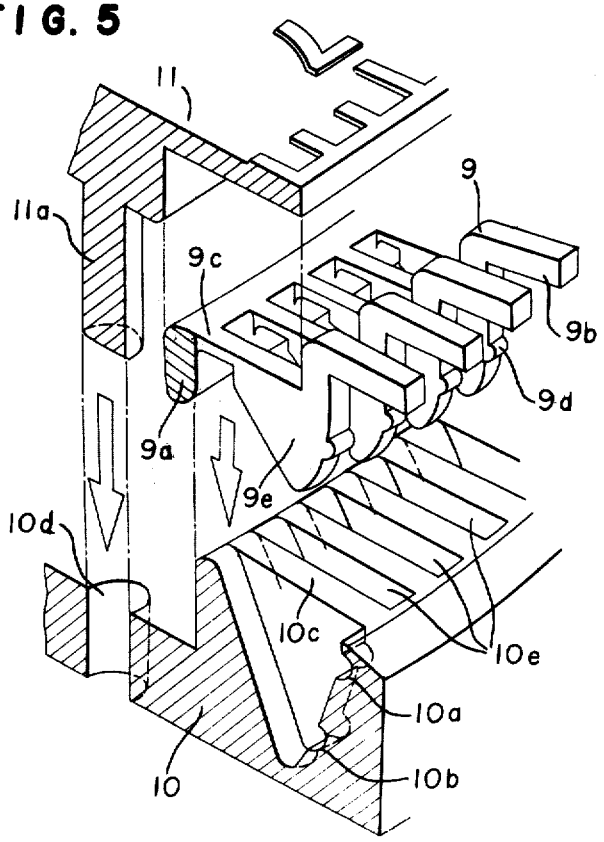
FIGS. 5, 6 and 7 are respectively views of one embodiment according to the present invention

Referring to FIG. 5, the structure will be illustrated. The change-over pawls (9) are projected in the radial direction with equal gaps from an annular joint ring (9*a*). Teeth (9*b*) are formed at each top end of each pawl so as to fit to the lever (3). Hinges (9*c*) are respectively formed as flexible thin body parts so as to shift the pawls (9) to the two positions. Main body parts (9*e*) are respectively formed at about the middle part of the pawls (9). The joint ring (9*a*), the teeth (9*b*), the thin body part (9*c*) and the main body parts (9*e*) are made of a resin in one piece. A cradle (10) holds the pawls (9) and has two grooves (10*a*), (10*b*) which are interlocked to interlockable projections (9*d*) formed on each main body part of each pawl (9). A scale plate (11) and the cradle (10) fix the joint ring (9*a*) of the pawls (9). The cradle (10) has a partition (10*c*) for preventing a movement of the pawls in the circumferential direction; holes (10*e*) are formed on the cradle (10) to face the main body parts (9*e*) so as to decide the positions and the pair of the grooves (10*a*), (10*b*) are formed on the inner surface of the holes.

Figure 6:
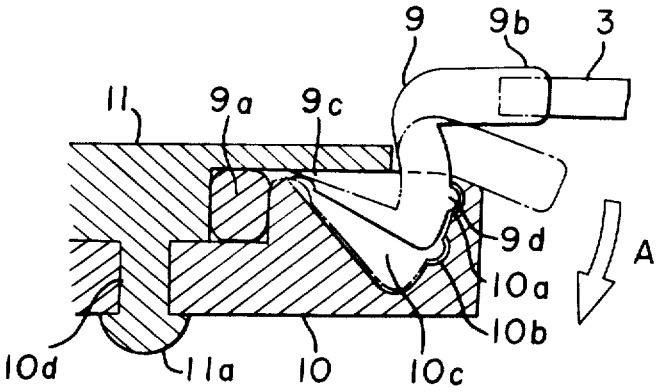

FIG. 6 shows the condition raising the pawl (9). The joint ring (9*a*) is held by the cradle (10) and the scale plate (11). The projections (9*d*) of the pawls are respectively interlocked to the upper groove (10*a*) of the cradle. In this condition, the change-over pawls (9) are press-contacted to the joint receiver (10) by resilience of the hinge (9*c*) which is far larger than that of the external force applied for the operation of the switch so that the pawls (9) are set at the desired position.

Figure 7:
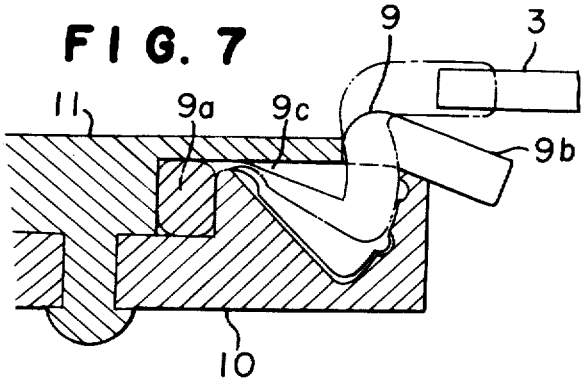

FIG. 7 shows the condition falling the pawls (9). The joint ring (9*a*) is held by the cradle (10) and the scale plate (11) as the condition shown in FIG. 6. The projections (9*d*) are respectively interlocked to the groove (10*b*) at the lower part of the cradle (10). Accordingly, the tooth (9b) is positioned to prevent the interlocking to the lever and the position is kept by the resilience of the hinge (9c).

The condition shown in FIG. 6 can be changed to the condition shown in FIG. 7 (the reverse change can be considered by the same manner) by detaching the interlocking of the projections (9d) to the upper groove (10a) by applying the force to the projections (9d) in the arrow line direction and riding the projections on the surface between the upper and lower grooves (10a), (10b) and then, interlocking the projections to the lower groove (10b). The radial shift of the pawls (9) during the movement is absorbed in the hinge (9c).

Thus, the pawls (9) can be selectively positioned at the two positions (to interlock to the lever or not to interlock to the lever) as that of the conventional time switch.

In the assembling of the time switch, as shown in FIG. 5, the pawls (9) and the scale plate (11) are superposed on the cradle (10) and the projections (11a) formed on the scale plate are inserted into the holes (10d) formed on the cradle (10) and three pieces of the parts are assembled in one-piece by a heat caulking etc. so as to obtain the scale plate part.

In accordance with the structure of the present invention, the following effect can be attained.

(1) Many change-over pawls are formed in one-piece at the same time whereby the time for preparing the parts can be remarkably shortened and a loss of the substance can be small and the uniformity of the parts is easily attained.

(2) Many pawls can be assembled at once whereby the operation is easy and the automatic assembling can be attained.

(3) Many pawls are formed in one-piece whereby a fault of the assembling in failure or error is not caused and the control of the parts is easily attained.

We claim:

1. A time switch comprising:

a cradle substantially in the form of a disk and rotatable about an axis;

a plurality of circumferentially spaced axial depressions on one axial surface of said cradle, said depressions being separated by partitions and including radially outwardly located depression walls including two detent means;

an annular element fixable adjacent said surface and concentric with said disk, said annular element being radially inward relative to said depressions;

a radially extending change over pawl for each of said depressions and each said pawl having substantially the same circumferential width as one of said depressions, each of said pawls having a radially inward end fixed to said annular element by an elastically deformable connecting means, a radially outward end adapted to selectively engage a switch element and an intermediate portion inserted in one of said depressions and having a surface including means selectively engageable with one of said detent means;

whereby said depression substantially encloses all of said pawl except for said radially outward end and said partitions prevent distortion of said pawls in the circumferential direction.

2. The time switch of claim 1 including a scale plate concentric with said cradle and, together with said cradle, enclosing said annular element and radially inward end of said pawl.

3. The time switch of claim 1 wherein said change over pawls are formed in one piece.

* * * * *